United States Patent [19]

Jekerle et al.

[11] Patent Number: 4,893,588

[45] Date of Patent: Jan. 16, 1990

[54] ADAPTIVE CONTROL TECHNIQUE FOR STEAM GENERATOR CLEANING

[75] Inventors: Jiri Jekerle, Baunatal Altenritte; Jean-Claude Hein, Niddatal, both of Fed. Rep. of Germany

[73] Assignee: Schmidt'sche Heissdampf GmbH, Kassel-Bettenhausen, Fed. Rep. of Germany

[21] Appl. No.: 376,689

[22] Filed: Jul. 7, 1989

Related U.S. Application Data

[63] Continuation-in-part of Ser. No. 263,176, Oct. 27, 1988.

[30] Foreign Application Priority Data

Oct. 29, 1987 [DE] Fed. Rep. of Germany ..... 3736668
Oct. 28, 1988 [DE] Fed. Rep. of Germany ..... 3836707

[51] Int. Cl.[4] ..... F22B 37/18; F22B 37/48

[52] U.S. Cl. ..... 122/379; 165/84; 165/95

[58] Field of Search ..... 165/95, 84; 122/379

[56] References Cited

U.S. PATENT DOCUMENTS 3,835,817 9/1974 Tuomaala ..... 122/379
4,653,578 3/1987 Horning ..... 165/84

*Primary Examiner*—Edward G. Favors
*Attorney, Agent, or Firm*—Chilton, Alix & Van Kirk

[57] ABSTRACT

An adaptive control technique, in which the duty cycle of a vibrational cleaning device for the heat exchange surfaces of a steam generator is automatically adapted to the current state of dirt accumulation on the surfaces. To ascertain the degree of dirt accumulation, the number of strokes of the drive cylinder of a fluidic actuator of the vibrational device is measured in a short interval at the beginning of each cleaning cycle and compared with a reference value. The cleaning cycle length or vibration period within the cycle is either lengthened or shortened commensurate with the results of the comparison and in this way the duty cycle of the vibrational device is continuously adapted to the current need for cleaning.

7 Claims, 1 Drawing Sheet

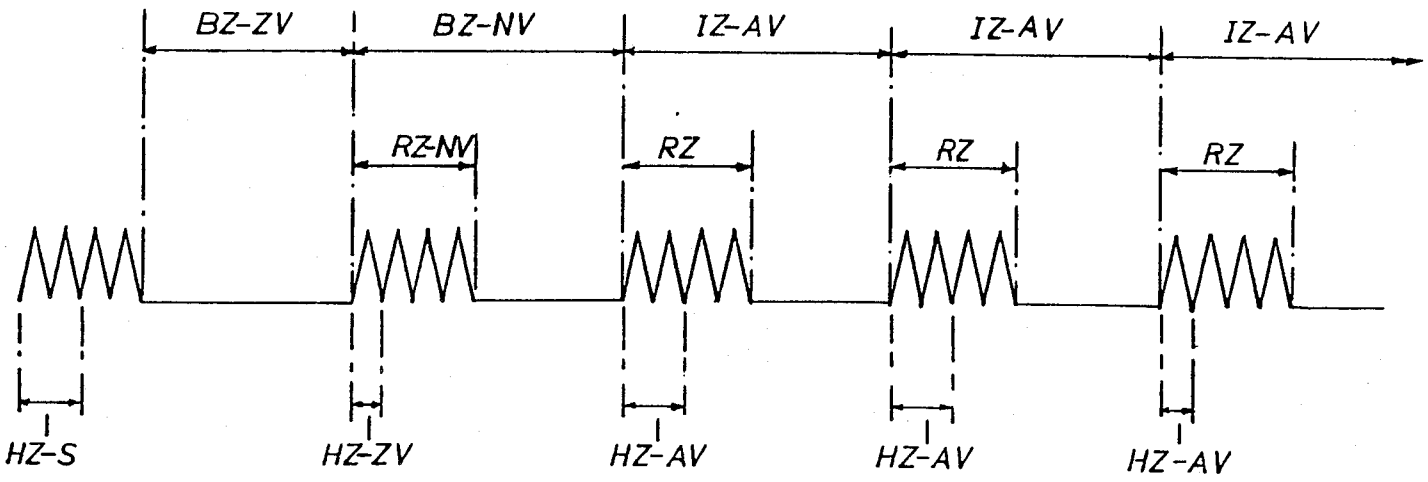
IZ-AV
IZ-AV
IZ-AV
BZ-NV
BZ-ZV
RZ
RZ
RZ
RZ-NV
HZ-AV
HZ-AV
HZ-AV
HZ-ZV
HZ-S

ADAPTIVE CONTROL TECHNIQUE FOR STEAM GENERATOR CLEANING

CROSS-REFERENCE TO RELATED APPLICATION

This application is a continuation-in-part of application Ser. No. 263,176, filed Oct. 27, 1988.

BACKGROUND OF THE INVENTION

1. Field of the Invention

The present invention relates to periodic cleaning of the heating surfaces of a steam generator and particularly to the mechanical removal of deposits from such surfaces. More specifically, this invention is directed to a vibrational cleaning method wherein the interval between or the duration of successively performed cleaning steps is determined as a function of past experience and the level of contamination and thus is continuously adapted to the current need for cleaning. Accordingly, the general objects of the present invention are to provide novel and improved methods of such character.

2. Description of the Prior Art

Heat transfer surfaces of steam generators, the outside of coiled tubes for example, are typically exposed to flue gases which may contain particulate matter which adheres to such surfaces. Heat transfer efficiency is adversely affected by such deposits of particulate matter. There are several known techniques for cleaning steam generator heating surfaces including various chemical treatment processes, "soot blowing" and inducing vibrations in the steam generator which cause the particulate matter to be mechanically separated from the surfaces.

In the case of vibrational cleaning, it is known to employ an actuator, for example a pair of vibration inducing coils, to impart motion to the coils of the steam generator, for example at the resonant frequency thereof.

The mechanical excitation of the device to be cleaned, i.e., a steam generator coil, has also been accomplished by means of a fluidic actuator, a compressed air cylinder and associated coil engaging member for example, which operates periodically over a period of time. The vibration process is repeated after a particular cleaning interval, the interval and the time during which the actuator is periodically energized comprising a cleaning cycle. In the prior art, the parameters of the cleaning cycle have customarily been preset, by means of clock mechanisms for example, and were not easily or automatically varied.

The degree of dirt accumulation on the tubes of a steam generator is dependent upon several factors including the chemical composition of the particulate matter entrained in the flue gas, the load on the steam generator and the flue gas temperature. Thus, the rate of contamination, and thus the rate at which heat exchange efficiency diminishes, is not constant. Accordingly, the prior art vibrational cleaning techniques, which employ fixed times for the cleaning cycle, were not satisfactory. It is also disadvantageous, but nevertheless the conventional prior art practice, to perform tests to determine the cleaning intervals for each mode of operation of the steam generator. This requires, at minimum, a very long break-in period while the tests are performed at all of the various combinations of expected operating conditions. Further, since the operating conditions, and thus the amount of dirt accumulation, can change over the course of time, cleaning in accordance with the originally determined cleaning intervals may not optimize the efficiency of operation of the steam generator and time consuming further tests and adjustments will often be required.

As described in published German Patent Application No. 2,036,061, attempts have been made to regulate the cleaning intervals as a function of temperature measurements. For this purpose, the temperature downstream of a heat exchanger coil of the steam generator or at the steam generator flue gas exit have been monitored. The exercise of control over vibrational cleaning as a function of measured temperature has, however, proven to be unsuitable in actual operation because the temperatures measured are dependent upon several operating parameters and do not allow any clear conclusion as to the degree of contamination of the heating surfaces. It is also to be observed that the temperature measurements themselves have been somewhat suspect, thus lessening the reliability of controlling vibrational cleaning as a function of monitored temperature, because of contamination of the temperature measuring devices themselves by exposure to a rather harsh operating environment.

SUMMARY OF THE INVENTION

The present invention overcomes the above-briefly discussed and other deficiencies and disadvantages of prior art vibrational cleaning methods, as applied to steam generators, by providing an adaptive control technique in which the cleaning intervals are automatically adapted to the current degree of contamination of the steam generator heat exchange surfaces. The technique of the present invention achieves optimal cleaning while avoiding unnecessarily long vibration periods.

In accordance with the present invention, the actuator device which delivers the energy which causes vibration of the steam generator coils is driven in such a manner as to always deliver the same energy to the member which is to be caused to vibrate, i.e., a constant driving force is utilized. This may, for example, be accomplished by using a pneumatic actuator which is driven by a constant pressure source. Upon initial steam generator installation, the actuator is energized and the number of cycles of vibration of the clean steam generator coil in a preselected short time interval are measured. This measurement may be accomplished by sensing the number of strokes ($HZ_S$) of the piston of the actuator which is mechanically coupled to the steam generator coil. Thereafter, during full load operation, the time ($BZ_{ZV}$) required for the heating surfaces of the steam generator coil to reach a permissible level of dirt accumulation (ZV) will be measured. The actuator is then again energized and the number of cycles ($HZ_{ZV}$) of vibration of the "dirty" steam generator coil which occur in the same preselected time as a result of the energy imparted thereto by the actuator will be measured. The heating surface will be cleaned, by the vibrational method, in a time period ($RZ_{NV}$) which includes the time in which $HZ_{NV}$ is measured. At the end of a further operational time ($BZ_{NV}$), measured from the beginning of the cleaning period of the cycle, the heating surface is again subjected to a vibrational cleaning in the time (RZ). During this second cleaning period of duration (RZ), the number of cycles of vibration ($HZ_{AV}$) during the preselected time is measured. The measured values are then employed to calculate a cycle time ($IZ_{AV}$) which determines when to initiate the next vibrational cleaning. The measurement of ($BZ_{NV}$) and ($HZ_{AV}$) is continually repeated during the operation of the steam generator and in accordance with a preferred embodiment, the cycle time ($IZ_{AV}$) is repeatedly recalculated while the cleaning time (RZ) is maintained constant. In the preferred embodiment, the number of strokes of the actuator ($HZ_{AV}$) is measured during a measuring time (MZ) of approximately five seconds which occurs during the cleaning time (RZ).

BRIEF DESCRIPTION OF THE DRAWING

The present invention may be better understood, and its numerous objects and advantages will become apparent to those skilled in the art, by reference to the accompanying drawing which is a graphical showing of the technique of the invention.

DESCRIPTION OF THE DISCLOSED EMBODIMENT

The present invention is based upon the recognition that the frequency of oscillation of an excited steam generator coil, and thus the number of strokes per unit of time of a fluidic actuator with constant driving force coupled to the coil, is dependent upon the total weight of the heating surface and thus is dependent upon the amount of dirt which has collected on the steam generator pipes. This indication of the degree of soiling of the heating surface is independent of all other parameters of operation such as, for example, flue gas speed and temperature. The frequency of oscillation is, however, dependent upon the driving force of the actuator such as, for example, the air pressure in the case of a pneumatic cylinder type actuator.

The frequency of oscillation, and thus the number of strokes of the actuator cylinder in the case of a fluidic actuator, declines with a decrease in driving force. Employing the adaptive control technique of the present invention, the length of the cleaning cycle will be shortened if actuator driving force declines. This is the desired effect and is a logical result of the fact that, with a low propulsion factor, the effectiveness of the vibrational cleaning decreases. Similarly, with a greater degree of dirt accumulation, the frequency of oscillation is lower.

The adaptive control technique for the cleaning intervals in accordance with the invention produces economic and safe cleaning, during both stable and variable operation of the steam generator, since the duty cycle of the actuator is continuously adjusted as a function of the current state of dirt accumulation. During "clean" operation of the steam generator, the adaptive control technique of the invention provides for a lengthening of the period between cleaning intervals and thus minimizes the energy expended for cleaning while simultaneously guarding the heating surfaces against premature wear resulting from mechanical vibration thereof. Also in accordance with the invention, the experimentation period during start-up is shortened because the adaptive control technique readily enables determination of the optimal cleaning interval.

It is to be understood that the technique of the present invention can be practiced by measuring either the frequency of vibration of the excited heat transfer surface or the number of cycles of a fluidic actuator coupled to the steam generator coil which occur over a preselected period of time, the measured parameter in either case being the result of energization of the actuator as to produce a constant driving force. It is also to be understood that the present invention can be employed to control either the interval time between cleanings or the duration of each cleaning period.

An example of the practice of the invention for the cleaning of the heat exchange of a steam generator by means of a vibration inducing device, the device having a fluidic actuator which provides a constant drive force, is as follows:

(a) The number of strokes of the actuator of the vibrational cleaning device in a preselected time when the heating surfaces are in a clean state was measured.

$$HZ_S = 2 \text{ sec.}^{-1}$$

This gives a reference value for additional measurements.

(b) The steam generator was run at full load and the operating time measured until the permissible level of soiling was reached.

$$BZ_{ZV} = 2 \text{ Hrs.}$$

(c) The duration of the cleaning process RZ was set constant at 20 sec.

$$RZ = 20 \text{ sec.}$$

(d) Upon attainment of the permissible soiling, the number of strokes of the actuator at the beginning of the cleaning process was measured as follows:

1.2 $\text{sec}^{-1}$, after 3 sec. cleaning 1.6 $\text{sec}^{-1}$ and after 6 sec. and until the end of the cleaning 1.8 $\text{sec}^{-1}$.

A certain basic soiling of the heating surface remained. The average number of strokes of the actuator in the first 3 sec. of the cleaning procedure was calculated to be:

$$HZ_{ZV} = 1.4 \text{ sec.}^{-1}$$

(e) The steam generator was operated for an additional time $BZ_{NV}$ ($BZ_{NV}$=30 min.).

$$BZ_{NV} = BZ_{NV}/4 = 30 \text{ min.}$$

(f) In the first 3 sec. of the cleaning procedure after $BZ_{NV}$, the average number of strokes of the actuator was determined to be:

$$HZ_{AV} = 1.6 \text{ sec.}^{-1}$$

(g) The interval $IZ_{AV}$ to the next cleaning procedure was calculated as follows:

$$IZ_{AV} = BZ_{NV}\frac{HZ_{AV}}{HZ_{ZV}} = 34.2 \text{ min.}$$

(h) During the next cleaning procedure, an average number of strokes in the 3 sec. measuring interval was determined to be:

$$HZ_{AV} = 1.5 \text{ sec.}^{-1}$$

(i) The interval $IZ_{AV}$ to the next cleaning procedure was calculated as follows:

$$IZ_{AV} = BZ_{NV}\frac{HZ_{AV}}{HZ_{ZV}} = 32.1 \text{ min.}$$

(j) If the load on the system increases, and thereby the amount of dust that goes through the steam generator increases, the heating surface gets dirty faster and a lower average number of strokes is measured.

$$HZ_{AV}=1.2 \text{ sec.}^{-1}$$

(k) The interval $IZ_{AV}$ to the next cleaning procedure is $$IZ_{AV} = BZ_{NV}\frac{HZ_{AV}}{HZ_{ZV}} = 25.7 \text{ sec.}$$

If the cleaning cycle time $IZ_{AV}$ is held constant, the duration of the cleaning period RZ must be varied. The control runs analogously to the above-described example, starting with step (c).

The present invention has been described by way of illustration and not limitation and various modifications and substitutions may be made thereto without departing from the spirit and scope of the invention. Accordingly, it is to be understood that the present invention has been described by way of illustration and not limitation.

What is claimed is:

1. An adaptive control method for the cleaning of a heat exchange surface of a steam generator by means of causing vibration thereof, the vibration being produced by an actuator which is driven with a constant force, the actuator being mechanically coupled to the surface to be cleaned, the method comprising the steps of:

measuring the number of vibrations of the surface resulting from operation of the actuator with the surface in a clean state;

measuring the operational time of the steam generator in which the surface reaches the permissible level of dirt accumulation;

measuring the number of vibrations of the surface resulting from operation of the actuator with the permissible level of dirt accumulation on the surface, cleaning the heating surface by causing vibration thereof for a first period of time;

operating the steam generator for a further period of time and then again causing vibration thereof for the said first time period and measuring the number of vibrations which occur in a short time period;

comparing the measured numbers of vibrations and calculating a parameter of the vibrational cleaning cycle as a function of the ratio of at least the last two measured numbers of vibrations; and continually repeat the measuring and calculating during the operation of the steam generator.

2. The method of claim 1, characterized by the fact that the measuring of the number of vibrations is performed during a short measuring time which occurs during a cleaning period.

3. The method of claim 1, characterized by the fact that the vibrations are measured by sensing the number of strokes of the output member of the actuator.

4. The method of claim 1, characterized by the fact that each cleaning cycle comprises a vibration time and a non-cleaning dwell time and wherein the parameter which is varied is dwell time.

5. The method of claim 1, characterized by the fact that each cleaning cycle comprises a vibration time and a non-cleaning dwell time and wherein the parameter which is varied is vibration time.

6. The method of claim 4, characterized by the fact that the vibrations are measured by sensing the number of strokes of the output member of the actuator.

7. The method of claim 5, characterized by the fact that the vibrations are measured by sensing the number of strokes of the output member of the actuator.

* * * * *